United States Patent [19]

Stecklow

[11] 4,129,396

[45] Dec. 12, 1978

[54] LOOSE LEAF BINDER WITH RIGID TELESCOPIC POST ASSEMBLIES AND MAGNETICALLY RETAINED BAR

[76] Inventor: James P. Stecklow, 8558 Broadview Rd., Broadview Heights, Ohio 44147

[21] Appl. No.: 792,036

[22] Filed: Apr. 28, 1977

[51] Int. Cl.[2] ..... B42F 3/02; B42F 3/30

[52] U.S. Cl. ..... 402/46; 402/59; 402/68

[58] Field of Search ..... 402/46, 48, 56, 59, 402/60, 68, DIG. 503

[56] References Cited

U.S. PATENT DOCUMENTS

| | | | |
|---|---|---|---|
| 1,044,753 | 11/1912 | Cooley | 402/48 |
| 2,285,525 | 6/1942 | Lotter | 402/48 X |
| 3,972,632 | 8/1976 | Carter | 402/46 |

*Primary Examiner*—Travis S. McGehee

*Attorney, Agent, or Firm*—Clarence A. O'Brien; Harvey B. Jacobson

[57] ABSTRACT

A loose leaf binder having a supporting base or lower cover member and a top cover member interconnected by post assemblies receiving a plurality of paper sheets together with a bar mounted on the post assemblies for longitudinal movement thereon with the bar being retained in adjusted position by magnetic attraction between the bar and post assemblies. Each of the post assemblies are constructed of rigid telescopic members.

8 Claims, 6 Drawing Figures

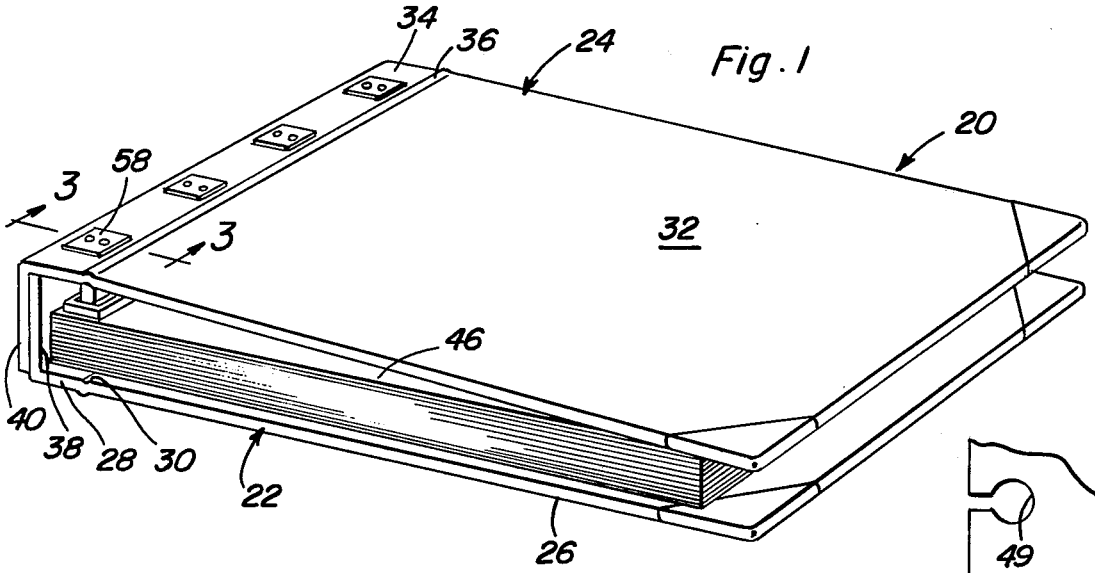
Fig. 1
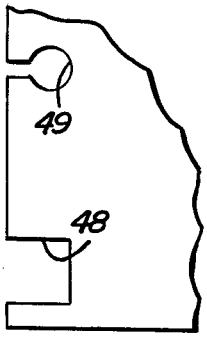
Fig. 5
Fig. 2
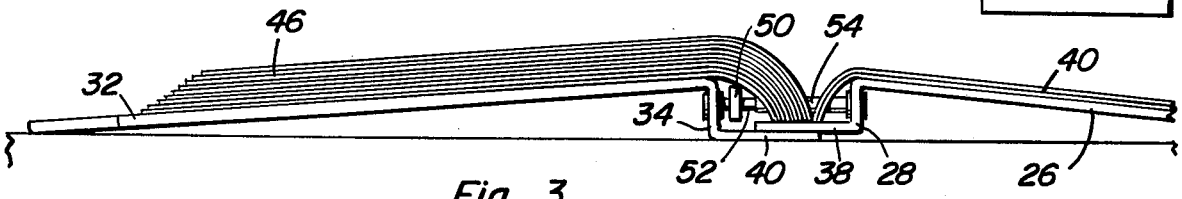
Fig. 3
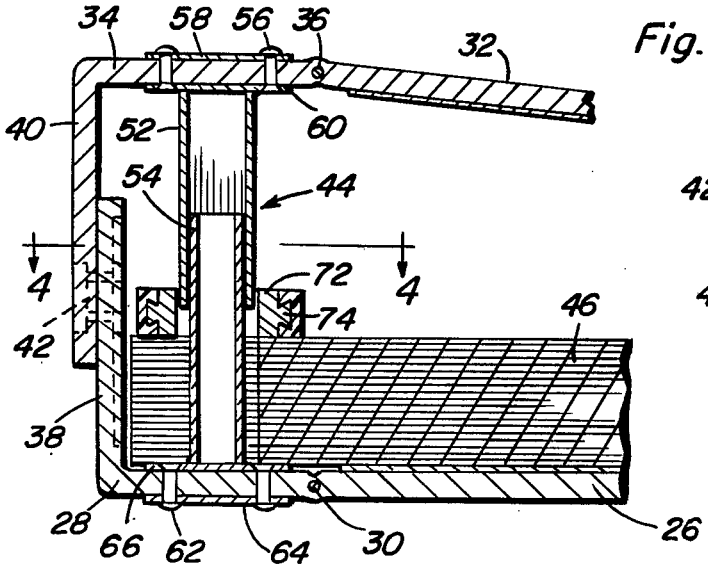
Fig. 4
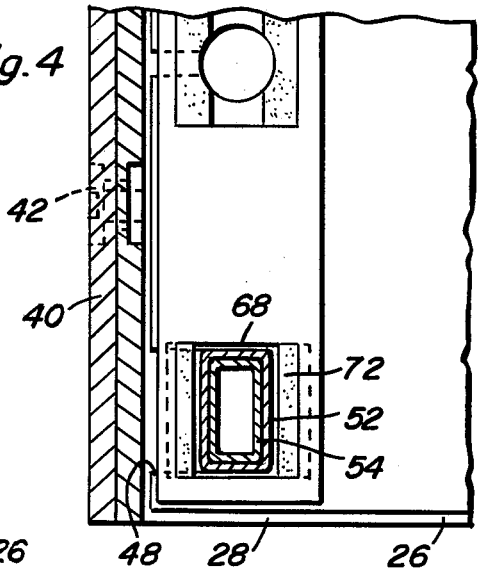
Fig. 6
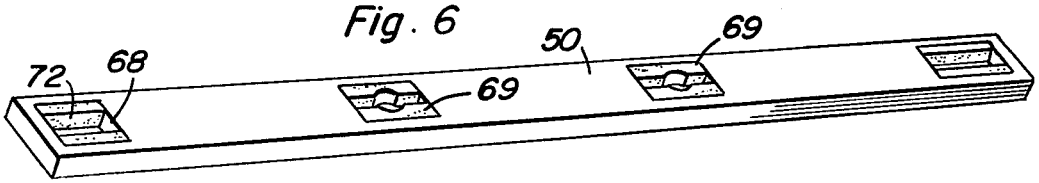

LOOSE LEAF BINDER WITH RIGID TELESCOPIC POST ASSEMBLIES AND MAGNETICALLY RETAINED BAR

BACKGROUND OF THE INVENTION

1. Field of the Invention

The present invention generally relates to loose leaf binders and more particularly that type of binder having telescopic assemblies receiving loose leaf sheets of paper, brochures, and the like, together with a retaining bar movably mounted on the post assemblies for retaining the sheets of paper in position thereon with the retaining bar being retained in place by magnetic attraction at any point along the length of the post assemblies.

2. Description of the Prior Art

Loose leaf binders having rigid posts interconnecting the two covers or a base and a hold-down bar or cover are well known with the posts receiving and retaining loose leaf sheets of paper, brochures, and the like. Various mechanical devices have been provided for varying the length of the post assemblies and various mechanical arrangements have been provided for forcibly moving the hold-down bar towards the bottom cover or base for securely clamping the stack of sheets in place. Several loose leaf binder arrangements are disclosed in my prior U.S. Pat. No. 3,684,390, issued Aug. 15, 1972, and other hold-down arrangements are shown in the prior patents cited during prosecution of the application which matured into that patent. In addition, the following U.S. patents disclose various leaf binders at least some of which employ a magnetic feature incorporated therein.

U.S. Pat. No. 911,125 — Feb. 2, 1909
U.S. Pat. No. 1,019,174 — Mar. 5, 1912
U.S. Pat. No. 1,380,694 — June 7, 1921
U.S. Pat. No. 2,497,332 — Feb. 14, 1950
U.S. Pat. No. 2,954,034 — Sept. 27, 1960
U.S. Pat. No. 3,008,470 — Nov. 14, 1961
U.S. Pat. No. 3,358,693 — Dec. 19, 1967
U.S. Pat. No. 3,670,646 — June 20, 1972
U.S. Pat. No. 3,701,605 — Oct. 31, 1972

SUMMARY OF THE INVENTION

An object of the present invention is to provide a loose leaf binder incorporating a supporting base or lower cover member and a top cover member interconnected by a plurality of telescopic rigid post assemblies which receive a stack of loose leaf papers, brochures, or the like, in which each of the post assemblies is longitudinally telescopic and includes two or more telescopic rigid tubular members.

A further object of the invention is to provide a loose leaf binder in accordance with the preceding object together with a bar magnetically mounted on the post assemblies with the bar serving as a retainer. Pressure on the retainer or hold-down bar can be applied or relieved by manually moving the bar against or away from the stack of loose leaf papers whether the top cover is opened or closed with the bar being retained in a stationary position by magnetic attraction between the bar and the post assemblies.

A still further object of the invention is to provide a loose leaf binder in accordance with the preceding objects in which the bar is provided with a permanent magnet assembly at each post assembly with each post assembly including a longitudinally extending member, the full length of which is capable of being attracted by the magnets in the bar for retaining the bar in any adjusted position along the length of the post assemblies in a manner to prevent complete free movement of the stack of loose leaf papers but enabling movement of the bar along the length of the post assemblies when manual pressure is exerted thereon when opening the loose leaf binder so that some of the loose leaves will extend in the opposite direction thus facilitating observation of the loose leaves in the area adjacent the post assemblies. When removing a brochure or individual paper, the top cover is opened thus exposing the stack of papers. The top cover and retaining bar are lifted upwardly and the sheet or brochure to be removed is grasped with the thumb and first finger and squeezed together thus sliding the end edges of the sheet clear of the end post assemblies and pulling the sheet or brochure outwardly from the intermediate post assemblies. An alternate method is to merely pull the sheet or brochure clear of the post assemblies.

Yet another object of the invention is to provide a loose leaf binder which is relatively easy to construct, easy to adapt to various types of loose leaf binders and inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the loose leaf binder illustrating the association of the components when the binder is closed.

FIG. 2 is a partial end view of the loose leaf binder illustrating the association of the components when the loose leaf binder is in open position.

FIG. 3 is a vertical, sectional view, on an enlarged scale, taken substantially upon a plane passing along section line 3—3 of FIG. 1 illustrating the specific structural details of one of the telescopic post assemblies and the bar mounted thereon with the top cover elevated for clarity.

FIG. 4 is a transverse, sectional view taken substantially upon a plane passing along section line 4—4 of FIG. 3 illustrating further structural details of the telescopic post assembly and bar mounted thereon.

FIG. 5 is a fragmental corner view of one of the sheets of material retained in the loose leaf binder illustrating the notches in the supported edge thereof.

FIG. 6 is a perspective view of the retaining bar adapted to be mounted on the telescopic post assemblies of the loose leaf binder.

DESCRIPTION OF THE PREFERRED EMBODIMENT

Referring now specifically to the drawings, the loose leaf binder illustrated therein is generally designated by reference numeral 20 and includes a supporting base or lower cover generally designated by numeral 22 and a top cover 24. The lower cover 22 includes an enlarged cover panel 26 that is hingedly connected to a base member 28 by a hinge structure 30 of any suitable type which may be in the form of a separate hinge or a hinge formed by a crease in the supporting base 22. The top cover 24 includes an enlarged top cover panel 32 corresponding in shape and configuration to the bottom cover panel 26 with the top cover panel 32 being connected to a top member 34 by a hinge structure 36 similar to hinge structure 30. The base member 28 and top member 34 are each provided with a spine member 38 and 40, respectively, as illustrated in FIG. 3, which overlap each other in telescoping relation with a suitable slot and fastener arrangement 42 interconnecting the spine members 38 and 40 to enable adjustment and limit the distance between the base member 28 and top member 34 with the fastener and slot arrangement 42 guiding and limiting the relative movement between the supporting base 22 and top cover 24. This type of spine is well known on various commercially available binders.

Extending between the supporting base 22 and the top cover 24 is a plurality of post assemblies 44 which receive and mount a plurality of loose leaf sheets or brochures 46 in the loose leaf binder with each loose leaf 46 having a notch 48 in each end edge thereof and intermediate notches 49 in the bound edge thereof which are shaped to match the shape of the respective post assemblies. The variety of shapes and configurations of the supporting post assemblies 44 and the notches 48 and 49 correspond to each other and may be varied with the distance between the centers of the supporting post assemblies being the same as the distance between the centers of the notches 48 and 49 so that the loose leaf sheets, brochures, or the like, may be inserted into or removed from the loose leaf binder without disassembly of the components of the binder. Also movably mounted on the supporting post assemblies 44 is a retaining bar 50 in the form of a relatively narrow but elongated rigid bar extending from end edge to end edge of the loose leaf sheets 46, as illustrated in FIG. 4.

Each post assembly 44 includes an upper tubular post 52 and a lower tubular post 54 with the internal dimensions of the upper tubular post 52 being slightly more than the external dimensions of the lower tubular post 54 for telescopic association, as illustrated in FIG. 3. The upper tubular post 52 is connected to the top member 34 by rivets 56 which extend through a washer or plate 58 on the upper surface of member 34 and a plate 60 rigid with the upper end of the tubular post 52. This assembly securely locks the tubular post 52 to the top member 34 so that the tubular post 52 is in perpendicular relation thereto. The lower tubular post 54 is anchored to the base member 28 in the same manner by using rivets 62, a washer or plate 64 thereunder and a plate 66 engaging the inner surface of the base member 28 and rigid with the bottom end of the tubular post 54, thus locking the lower tubular post 54 to the base member 28. With this construction, the tubular post members 52 and 54 may telescope in relation to each other to the limits of their length and within the limits defined by the fastener and slot assembly 42 interconnecting the spine members 38 and 40.

The bar 50 is in the form of an elongated rectangular member having an opening 68 at each end thereof and intermediate openings 69 spaced in a manner to receive the intermediate post assemblies 44. Permanent magnets 72 are oriented peripherally of each opening. The magnets 72 parallel the surfaces of the post assembly 44 and are secured to the bar 50 in any suitable manner, such as by bonding, or the like, although as illustrated in FIG. 3, each magnet 72 may be provided with a projection 74 which is secured to the bar 50 which may be conveniently of a plastic material whereby the bar 50 may be molded around the projection 74 on the magnet 72. Thus, the magnets 72 the post assembly 44, as illustrated in FIG. 4. As illustrated, the endmost post assemblies 44 are generally of rectangular cross-sectional configuration which is the same shape as the notches 48 and the same shape as the opening defined by the magnets 72 and the end edges of the opening 68 in the bar 50. The intermediate post assemblies 44 are cylindrical in cross-sectional configuration and the notches 49 are keyhole-shaped to correspond to the intermediate post assemblies and enable insertion and removal of the loose leaves. It is pointed out that the shape and configuration of the post assemblies, the notches and the openings may be varied. Also, the material from which the bar 50 is constructed may be varied with plastic being preferred. The permanent magnets 72 may be commercially available permanent magnets and the posts 52 and 54 are constructed of suitable ferrous metal or other material having the capability of being attracted by the magnets 72. Magnets may be used on only the end openings 68, if desired. Also, the use of intermediate post assemblies is optional depending upon the physical characteristics of the sheets or brochures to be bound and the use requirements for the binder.

In use of the invention, the retaining bar 50 will retain the loose leaf sheets or brochures 46 in stacked relation by virtue of the magnetic attraction between the magnets 72 and the post assemblies. When it is desired to insert additional loose leaf sheets or brochures or remove loose leaf sheets or brochures, the bar 50 may be easily lifted vertically. If the effective length of the post assemblies 44 is to be adjusted, just move the covers apart. Prior to opening the loose leaf binder 20, the retaining bar 50 should be manually raised longitudinally along the post assemblies, such as illustrated in FIG. 2, so that the facing surfaces of adjacent loose leaf sheets will be spaced apart sufficiently to enable any indicia in this area to be easily observed. Thus, the bar 50 does not exert a downward force on the stack of sheets or brochures other than the weight of the bar and forces exerted manually thereon by hand with the hold-down bar thus retaining the loose leaf sheets in place.

In this arrangement, since the tubular posts 52 and 54 are of rigid construction, the base member 28 and the top member 34 are retained in parallel relation to each other even when the loose leaf binder is opened as illustrated in FIG. 2. Thus, the bottom cover panel 26 and the top cover panel 32 will be downwardly and outwardly inclined in order for them to engage a supporting surface as illustrated in FIG. 2 when the spine of the loose leaf binder is supported on a surface and the binder opened by swinging the panels 26 and 32 downwardly about hinge structures 30 and 36.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A loose leaf binder for loose leaf sheets or brochures and enabling individual sheets or brochures to be removed or added without taking the binder apart and without removing additional sheets or brochures, said binder comprising a supporting base, a top member spaced from the base and adapted to receive a plurality of loose sheets of material therebetween, a plurality of post assemblies extending between the supporting base and top member for receiving and mounting the loose leaves, each post assembly including a pair of tubular members with one of the tubular members being supported from the supporting base and the other of the tubular members being supported from the top member, the inner ends of the tubular members being disposed in telescoping relation to enable variation in the length of each post assembly, and a hold down means which adheres to at least one of said tubular members and is adjustable relative thereto for holding said sheets or brochures in place by exerting pressure thereon.

2. The structure as defined in claim 1 wherein said hold down means is a retaining bar having a plurality of openings therein longitudinally movably supported by the post assemblies, said retaining bar including magnet means adjacent each opening, each post assembly being constructed of material subject to magnetic attraction whereby the retaining bar will be magnetically retained in adjusted position but movable along the post assemblies when manual pressure is exerted thereon.

3. The structure as defined in claim 1 wherein said tubular members forming each post assembly are of rigid construction and are rigid with the supporting base and top member.

4. The structure as defined in claim 3 wherein said supporting base and top member are interconnected by a spine member generally parallel to the post assemblies, said spine member being rigid with portions of the base and top member to which the rigid tubular members are affixed.

5. The structure as defined in claim 4 wherein said spine member include telescopically associated components to enable variation in the length of the post assemblies and variation in the capacity of the binder.

6. A loose leaf binder comprising a supporting base, a top member spaced from the base, a plurality of loose sheets of material therebetween, at least one post assembly extending between the supporting base and top member and receiving and mounting the loose leaves, said post assembly including a pair of telescopic members with one of the telescopic members being supported from the supporting base and the other of the telescopic members being supported from the top member, the inner ends of the telescopic members being disposed in overlapping relation to enable variation in the length of the post assembly without separation of the telescopic members, a retaining bar longitudinally movably supported on the post assembly in engagement with a stack of loose leaves, said retaining bar including magnetic means thereon, said post assembly being constructed of material subject to magnetic attraction whereby the retaining bar will be retained in adjusted position but movable along the post assembly when manual pressure is exerted thereon.

7. The structure as defined in claim 6 wherein said telescopic members forming the post assembly are of tubular rigid construction and are rigid with the supporting base and top member, said base and top members having a hinge structure adjacent the post assembly to enable the binder to be opened.

8. The structure as defined in claim 7 wherein said top member and base are interconnected by a spine member having rigid adjustable components rigidly affixed to the portions of the base and top member which have the rigid tubular members rigidly affixed thereto.

* * * * *